US007752871B2

(12) United States Patent
Cho et al.

(10) Patent No.: US 7,752,871 B2
(45) Date of Patent: Jul. 13, 2010

(54) LAUNDRY MACHINE

(75) Inventors: Han Ki Cho, Gimhan-si (KR); Jong Sun Yoon, Jinju-si (KR); Sung Gi Hwang, Changwon-si (KR); Ho Sung Jang, Daegok-si (KR); Chang Woo Son, Gimhae-si (KR); Jae Cheol Lyu, Changwon-si (KR)

(73) Assignee: LG Electronics Inc., Seoul (KR)

( * ) Notice: Subject to any disclaimer, the term of this patent is extended or adjusted under 35 U.S.C. 154(b) by 927 days.

(21) Appl. No.: 11/476,937

(22) Filed: Jun. 29, 2006

(65) Prior Publication Data

US 2007/0130998 A1 Jun. 14, 2007

(30) Foreign Application Priority Data

Jun. 30, 2005 (KR) ..... 10-2005-0057821
Jun. 30, 2005 (KR) ..... 10-2005-0058011

(51) Int. Cl.
*D06F 39/00* (2006.01)

(52) U.S. Cl. ..... 68/12.27; 68/12.01; 68/12.23

(58) Field of Classification Search ..... 68/12.01, 68/12.23, 12.27

See application file for complete search history.

(56) References Cited

U.S. PATENT DOCUMENTS 5,737,039 A * 4/1998 Lopez et al. ..... 348/836
7,586,053 B2 * 9/2009 Kim et al. ..... 200/296
2004/0173691 A1 * 9/2004 Hall ..... 236/91 D
2005/0025503 A1 * 2/2005 Astrauskas ..... 398/202
2005/0210926 A1 * 9/2005 Kwon et al. ..... 68/3 R
2006/0289533 A1 * 12/2006 Park et al. ..... 219/757
2007/0209227 A1 * 9/2007 Park ..... 34/523
2007/0209403 A1 * 9/2007 Byun et al. ..... 68/3 R
2007/0220926 A1 * 9/2007 Yoon ..... 68/3 R

FOREIGN PATENT DOCUMENTS

DE 20 2004 004 002 9/2005

OTHER PUBLICATIONS

German Office Action dated Mar. 24, 2009.

* cited by examiner

*Primary Examiner*—Michael Barr
*Assistant Examiner*—Jason Heckert
(74) *Attorney, Agent, or Firm*—KED & Associates, LLP

(57) ABSTRACT

The present invention relates to laundry machines, and more particularly, to a control unit assembly in a laundry machine which enables easy assembly and accurate alignment of an input device of a printed circuit board with a button portion of a control panel.

The control unit assembly includes a control panel having various operation buttons and coupling portions, a plurality of coating guides coupled to a rear surface of the control panel having fastening portions corresponding to the coupling portions, a plurality of printed circuit boards respectively mounted on the coating guides, each having an electric circuit mounted thereon, joining portions for joining the coating guides together so as to place the coating guides closer to an inside of the control panel, and holders for preventing the coupling portions and fastening portions from moving with respect to each other when the fastening portions are aligned with the coupling portions, thereby improving assembly work, preventing malfunction of the laundry machine, and permitting easy detection of an operation progress.

19 Claims, 9 Drawing Sheets

LAUNDRY MACHINE

CROSS-REFERENCE TO RELATED APPLICATION

This application claims the benefit of Korean Application Nos. 10-2005-0057821 and 10-2005-0058011 both filed on Jun. 30, 2005, which are hereby incorporated by reference as if fully set forth herein.

BACKGROUND OF THE INVENTION

1. Field of the Invention

The present invention relates to laundry machines, and more particularly, to a control unit assembly for controlling a laundry machine.

2. Discussion of the Related Art

In general, the laundry machine is a general term for a washing machine for washing and spinning, a dryer for drying, a dryer and washing machine for washing and drying. In the washing machines, there are a drum type washing machine and a pulsator type washing machine.

Of the washing machines, the drum type washing machine removes dirt from laundry by friction taken place between washing water and the laundry as the laundry is dropped by a weight of the laundry lifted as a drum coupled to a motor with a shaft rotates in regular/reverse directions by rotation force of the motor, after introduction of the laundry into the drum type washing machine, and supply of the washing water to the drum through a detergent box together with detergent in the detergent box.

Owing to less entangling of the laundry, and an excellent washing capability compared to the pulsator type washing machine, recently the drum type washing machines spread, rapidly.

A related art drum type washing machine will be described with reference to FIG. 1.

The drum type washing machine is provided with a substantially hexahedral body 1, having a laundry opening in a front for introduction and taking out the laundry, with a door 2 on one side of the front having the laundry opening for selective opening/closing of the laundry opening.

At an upper portion of the front of the body 1, there is a control unit 3 for operation of the drum type washing machine.

The control unit 3 is provided with a plurality of buttons and a rotary knob for user's application of washing functions, and a display window for displaying a progress of operation of the drum type washing machine.

The control unit 3 assembly will be described in more detail with reference to FIG. 2.

The control unit is provided with a control panel 31 which forms an exterior of the control unit 3, a printed circuit board (PCB) 32 having various electric devices mounted thereon, and a coating guide 33 for mounting the PCB 32.

The control panel 31 is provided with fastening portions for coupling the coating guide 33 thereto. The fastening portions are fastening bosses 31*a* projected outwardly from a rear surface of the control panel 31, respectively.

Moreover, on the front of the control panel 31, there are a plurality of pass through holes 31*b*, buttons 31*c*, and transparent windows 31*d*, for user's easy operation and notice of operation progress.

Referring to FIGS. 2 and 3, in order to make the exterior of the drum type washing machine elegant, the exterior of the control panel 31 is curved.

Mounted on the PCB 32, there are electric devices for controlling operation of the drum type washing machine, input devices 32*a*, such as the knob or switches, and so on for transmission of control signals of the drum type washing machine to the control unit (not shown), and display devices 32*b*, such as LED lamp, for displaying a progress of operation.

The coating guide 33 receives the PCB 32, and has fastening portions 331 at an upper portion and a lower portion in correspondence to the fastening bosses 31*a* on the control panel 31 for coupling the coating guide 33 to the control panel 31.

Each of the fastening portions 331 has a fastening hole 331*a*. At the time of coupling the coating guide 33 to the control panel 31, the fastening bosses 31*a* and the fastening holes 331*a* are brought into contact respectively, and screws are driven thereto from a rear surface of the fastening portions 331.

However, the related art control unit assembly has the following problems.

First, as can be known from FIG. 3, the coupling of the coating guide 33 having the PCB mounted thereon to an inside of the control panel 31 with the curved exterior surface causes to form a large gap T between the input devices 32*a* and the display devices 32*b* on the PCB and the control buttons and so on on the control panel 31, to cause problems of defective contact between the input device 32*a* and the buttons 31*c*, and poor brightness of the display device 32*b* at the transparent window 31*d* due to the large gap between the display device 32*b* and the transparent window 31*d*.

Second, referring to FIG. 4, there have been poor alignments happened between the coating guide 33 having the PCB mounted thereon and the control panel 31 in processes of coupling the coating guide 33 to the control panel 31, i.e., the input device 32*a* and the display device 32*b* on the PCB 32 are aligned with the buttons and the transparent window on the control panel 31, inaccurately.

That is, in the process for coupling the coating guide 33 to the control panel 31, there can be misalignment between the fastening hole 331*a* in the fastening portion 331 and the screw hole in the fastening boss 31*a*. In this case, it is liable that the worker forcibly fastens a screw through the screw hole in the fastening boss 31*a* and the fastening hole 331*a* in the fastening portion 331, failing exact contact of the button on the control panel 31 with the input device 32*a* on the PCB 32 and exact match between the LED lamp 32*b* of the PCB 32 and the transparent window 31*d* in the control panel 31.

The mismatch between the LED lamps 32*b* with the transparent window 31*d*, causing the LED lamps to illuminate wrong transparent windows, is liable to make the user misunderstand operation of the drum type washing machine.

SUMMARY OF THE INVENTION

Accordingly, the present invention is directed to a laundry machine that substantially obviates one or more problems due to limitations and disadvantages of the related art.

An object of the present invention is to provide a laundry machine having a control unit assembly of an improved structure which can improve an assembly work of the control unit assembly, and enables exact match between relevant components in the assembly.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine includes a drum, a cabinet which forms an exterior of the laundry machine and protects the drum, a control panel having various operational buttons for operation of the drum, and coupling portions, a plurality of coating guides having fastening portions corresponding to the coupling portions for mounting to a rear surface of the control panel, a plurality of printed circuit boards (PCB) respectively mounted on the coating guides each having an electric circuit mounted thereon, joining portions for joining the coating guides together so as to place the coating guides closer to an inside of the control panel, and holders for preventing the coupling portions and the fastening portions from moving with respect to each other at the time the coupling portions are brought closer to the fastening portions, respectively.

Preferably, the fastening portion includes walls on an upper portion of the coating guide having fastening hole, and the holder includes at least one rib projected from the wall around the fastening hole.

Preferably, the holders are formed opposite to each other with respect to the fastening hole.

Preferably, the coupling portion includes a fastening boss, and the holder has an end sloped for easy placing in of the fastening boss.

Preferably, the holders opposite to each other with respect to the fastening hole is distanced enough to allow sliding of the fastening boss.

Preferably, the fastening portion is walls on an upper portion of the coating guide, and the holder is a cylinder projected from the wall around the fastening hole.

Preferably, the cylinder has an inside diameter with a size enough to allow sliding of the fastening boss.

Preferably, the fastening portion is walls on an upper portion of the coating guide, and the holder is an arc projected from the wall around the fastening hole.

The holder may be formed on an upper side and a lower side or a left side and a right side of the fastening hole.

Preferably, the joining portion is formed on a side of each of the coating guides.

Preferably, the coating guides joined together form an outside appearance having a curvature at which the PCBs and the operation buttons can be placed closer.

Preferably, the joining portion includes a hook on one of the coating guide, and a joining surface on the other coating guide having a hook hole for holding the hook.

Preferably, at least one hook and hook hole are formed, respectively.

Preferably, a plurality of hooks are formed, and the plurality of hooks have holding directions to be held at the hook holes different from one another.

Preferably, the joining portion further includes position guide means for guiding the hook to the hook hole for easy fastening of the hook to the hook hole.

Preferably, the position guide means includes a guide projection from one of the coating guides, and a guide projection receiver at the other coating guide for receiving the guide projection.

Preferably, the projection is adjacent to the hook.

Preferably, at least one of the guide projections and the guide projection receivers are formed, respectively.

In another aspect of the present invention, a control unit assembly includes a control panel having various operation buttons and coupling portions, a plurality of coating guides coupled to a rear surface of the control panel having fastening portions corresponding to the coupling portions, a plurality of printed circuit boards respectively mounted on the coating guides, each having an electric circuit mounted thereon, joining portions for joining the coating guides together so as to place the coating guides closer to an inside of the control panel, and holders for preventing the coupling portions and fastening portions from moving with respect to each other when the fastening portions are aligned with the coupling portions.

The drum type washing machine of the present invention has the following advantages.

The placing of the PCB mounted on the coating guide closer to the inside of the control panel, enabling accurate alignment of the buttons and the transparent windows on the control panel with the input devices on the PCB, permits to enhance perfection of the product.

The placing of the PCB mounted on the coating guide closer to the inside of the control panel, enabling accurate alignment of the buttons and the transparent windows on the control panel with the input devices on the PCB, permits smooth operation of the buttons, and to provide an accurate operation progress to the user.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A control unit assembly 3 of a drum type washing machine will be described with reference to FIG. 5.

Figure 1:
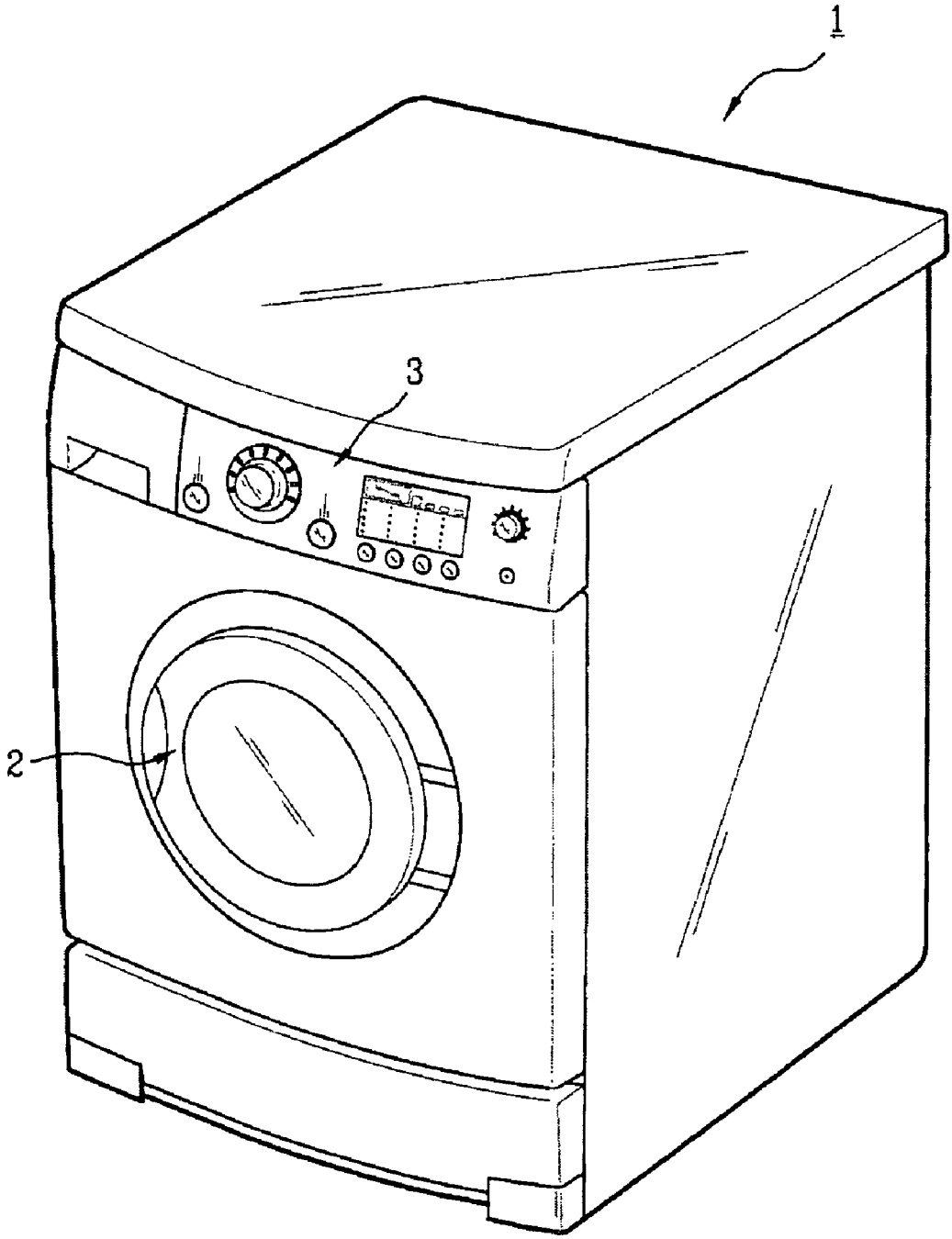
FIG. 1 Prior Art
FIG. 1 illustrates a perspective view of a related art drum type washing machine.
Figure 2:
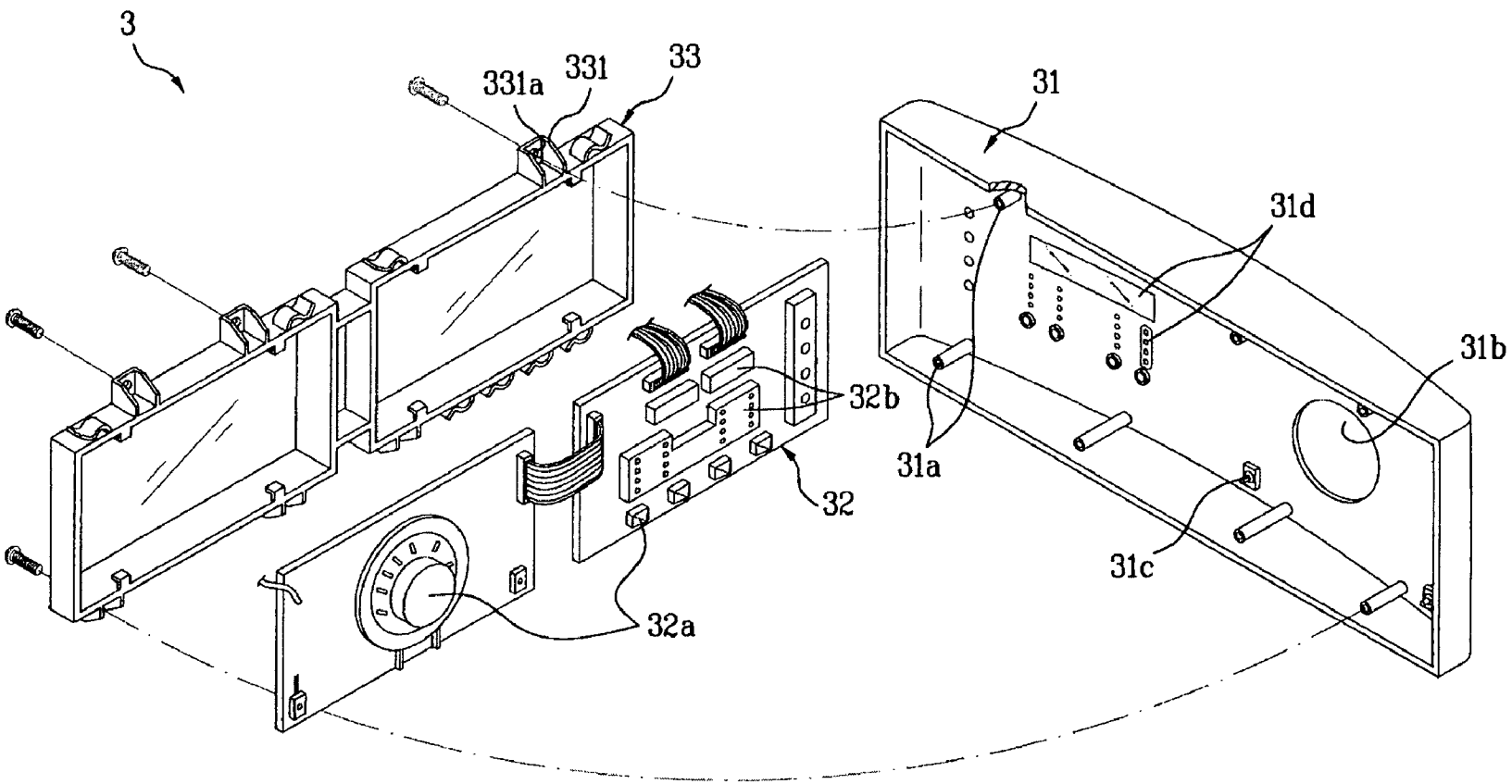
FIG. 2 Prior Art
FIG. 2 illustrates an exploded perspective view of a control unit of a related art drum type washing machine.
Figure 3:
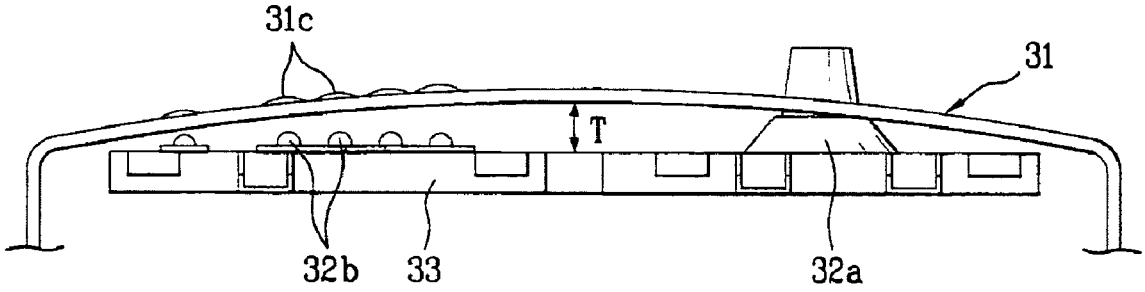
FIG. 3 Prior Art
FIG. 3 illustrates a plan view of a control unit of a related art drum type washing machine, schematically.
Figure 4:
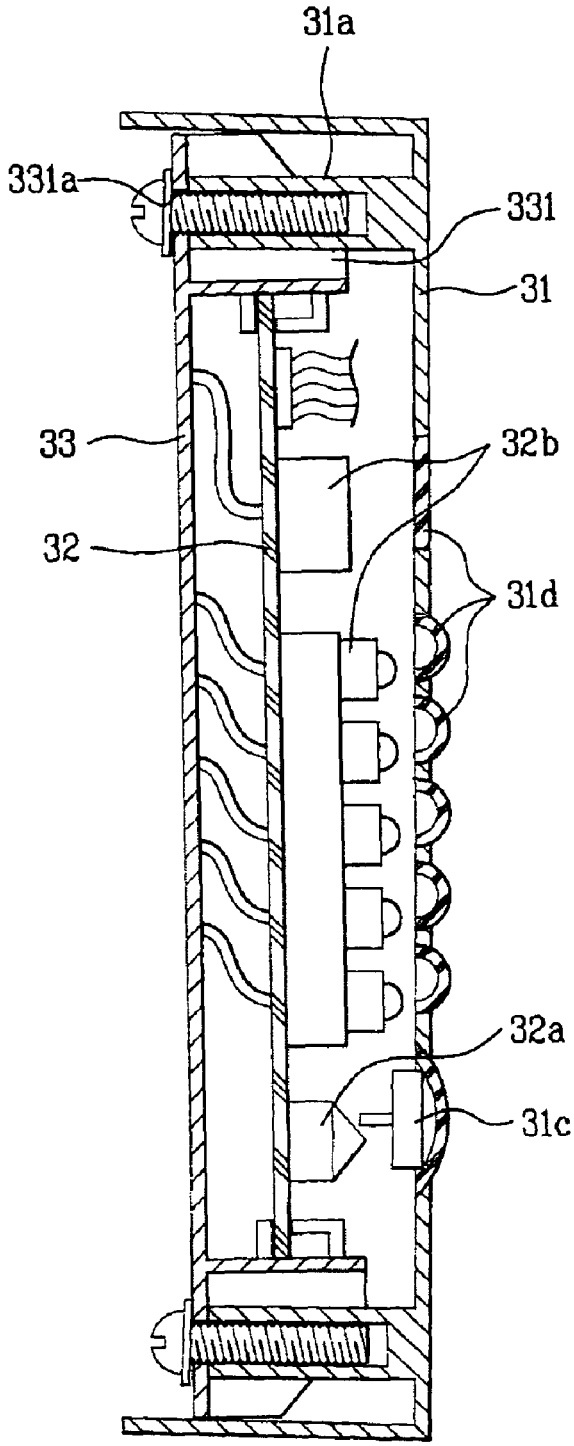
FIG. 4 Prior Art
FIG. 4 illustrates a transverse section of a control unit of a related art drum type washing machine.
Figure 5:
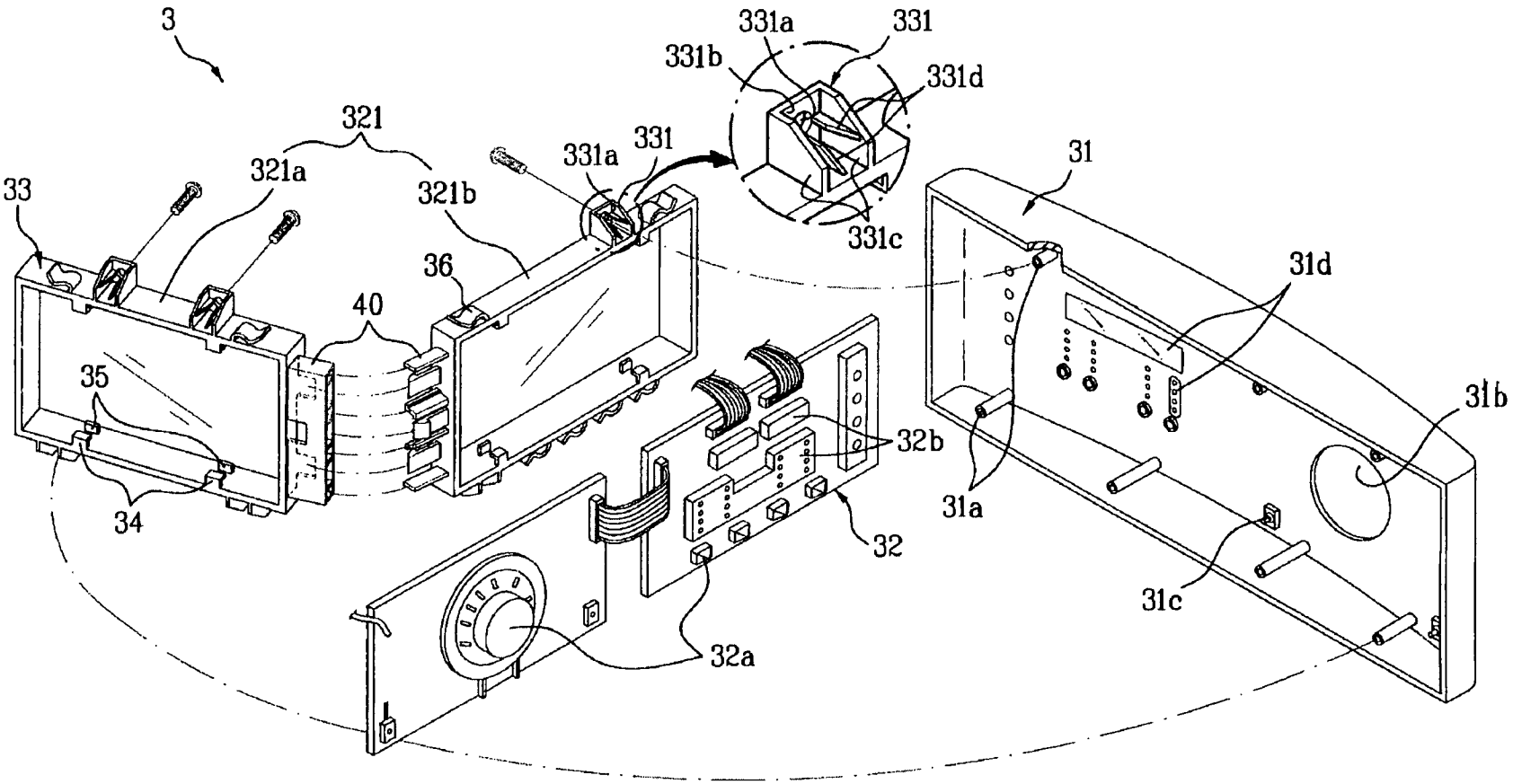
FIG. 5 illustrates an exploded perspective view of a control unit of a drum type washing machine in accordance with a preferred embodiment of the present invention.

Referring to FIG. 5, the control unit 3 assembly includes a printed circuit board (PCB) 32 having various electric devices mounted thereon for operation of the drum type washing machine, a control panel 31 which forms an exterior of the control unit, and a coating guide 33 having the PCB 32 mounted thereon and fastening portions 331 for coupling the coating guide 33 to the control panel 31.

The PCB 32 has the electric devices mounted thereon for controlling the drum type washing machine.

The PCB 32 has input devices 32*a*, such as switches and knobs, for user's direct control of the electric devices, as well as display devices 32*b*, such as LED lamps for displaying a progress of washing of the drum type washing machine.

In the meantime, after mounting the PCB 32 on the coating guide 33, coating liquid is applied thereto as an water proof treatment.

This is because the drum type washing machine 1 has frequent contact with water due to the introduction/taking out of the wet laundry. That is, the coating prevents the electric devices on the PCB 32 from being happened to contact with water.

On the other hand, the control panel 31 forms an exterior of the control unit and protects the electric devices mounted on the PCB 32.

In addition to this, the control panel 31 has button portions 31*c* connected to the input devices 32*a* on the PCB 32 for user's control of the drum type washing machine from an outside thereof, and transparent windows 31*d* for transmission of a light from the display devices 32*b* on the PCB 32.

It is preferable that the button portions 31*c* are push buttons for user's easy operation.

It is preferable that the control panel 31 has fastening portions for coupling the coating guide 33 to the control panel 31, preferably formed of a plurality of fastening bosses 31*a*.

The coating guide 33 includes a body 321 of rectangular plates each having a cavity for receiving the PCB 32, and a plurality of fastening portions 331 at an upper portion and a lower portion of the body 321.

It is preferable that the body 321 has individual bodies in correspondence to a number of the PCBs 32. For reference, though the embodiment shows two bodies 321 and two PCBs 32, number of the bodies 321 and the PCBs 32 are not limited to two. In the following description of the embodiment, the individual bodies 321*a* and 321*b* will be called as a first body 321*a* and a second body 321*b*.

In the meantime, it is preferable that each of the bodies 321*a* and 321*b* has supporting members 35 formed on an inside for supporting the PCB 32, more preferably with holding members 34 for preventing the PCB 32 supported thus from falling off to an outside of the body 321*a*, or 321*b*.

The fastening portions 331 at the upper portion and the lower portion of the body 321 are formed to match to the fastening bosses 31*a* on the inside of the control panel 31.

In this instance, the fastening portion 331 has at least one face directed upward vertically, and a fastening hole 331*a* in a fastening surface 331*b* opposite to the fastening boss 31*a*.

Also, the fastening portion 331 has opposite walls 331*c*, and a holder 331*d* on an inside of each of the opposite walls 331*c* and on an upper surface of the body 321 in contact to the inside of the opposite walls 331*c* perpendicular thereto.

It is preferable that the holder 331*d* is a rib projected outwardly from a fastening surface 331*b*, more preferably three in total around the fastening hole 331*a*. This is for making movement of the fastening boss 31*a* the smallest by supporting the fastening boss 31*a* from three directions at the time the fastening boss 31*a* of the control panel 31 is in contact with the fastening hole 331*a*.

It is preferable that the ribs 331*d* have distances centered on the fastening hole 331*a* which permits the fastening boss 31*a* slide.

It is preferable that the body 321 has a plurality of wire fastening ribs 36 formed on upper and lower sides of the fastening portion 331 for fastening wires lead from the PCB 32.

The body 321 has joining portions 40 for joining the individual bodies 321*a* and 321*b* together. The joining portions 40 are on sides of the bodies 321*a* and 321*b* respectively, for joining the bodies 321*a* and 321*b*, together.

Figure 6:
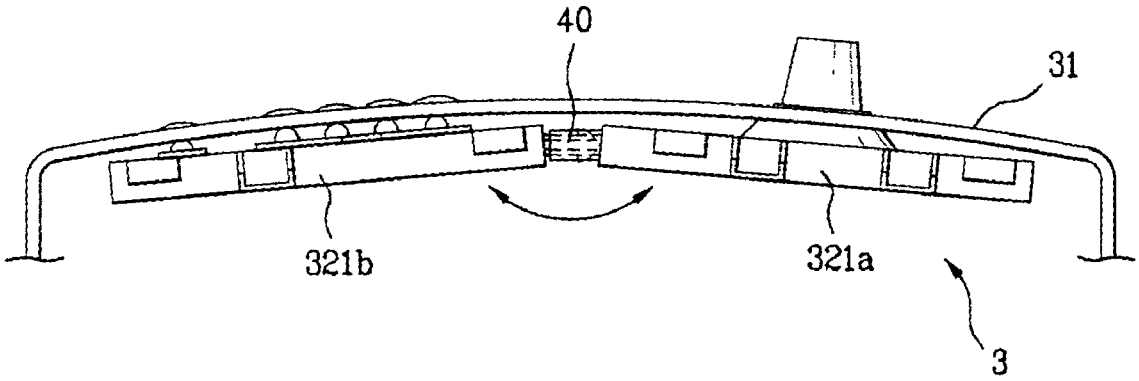
FIG. 6 illustrates a plan view of a control unit of a drum type washing machine in accordance with a preferred embodiment of the present invention, schematically.

In this instance, referring to FIG. 6, it is preferable that a plan view of an outside appearance of the first body 321*a* and the second body 321*b* joined together with the joining portions 40 is not in straight line, but knuckled at a predetermined angle.

It is preferable that the curvature the two bodies 321*a* and 321*b* form is the same with the curvature of the exterior of the control panel 31. This is for placing the input devices 32*a* on the PCB 32 mounted on the coating guide 321 closer to the button portions 31*c*, the transparent windows 31*d* and so on of the control panel 31.

That is, this is for enhancing accuracy of alignment of the button portions 31*c* with the input devices 32*a* by placing the input devices 32*a* closer to the button portions 31*c* of the control panel 31 at the time the coating guide 32 is coupled to the control panel 31.

The joining portion 40 will be described in more detail with reference to FIG. 7.

The joining portion 40 includes hooks 41 on a side of the second body 321*b* of the plurality of individual bodies 321*a* and 321*b*, and a joining surface 42 having hook holes 42*a* on a side of the first body 321*a* which is to be coupled to the second body 321*b* for holding the hooks 41 on the second body 321*b*.

Though the embodiment shows the hooks 41 on the second body 321*b* and the joining surface 42 on the first body 321*a*, it does not matters even if positions of the hooks 41 and the joining surface 42 are interchanged.

It is preferable that numbers of the hooks 41 and the joining surfaces 42 are at least one, respectively. It is preferable that at least one hook hole 42*a* is formed in the joining surface 42, for enabling hooking of a plurality of hooks 41 to the joining surface 42.

The embodiment shows three hooks 41 on the side of the second body 321*b*. The joining surface 42 has spaces for receiving the hooks 41 respectively, and sockets each with a hook hole 42*a* in a circumference for holding the hooks 41.

Figure 7:
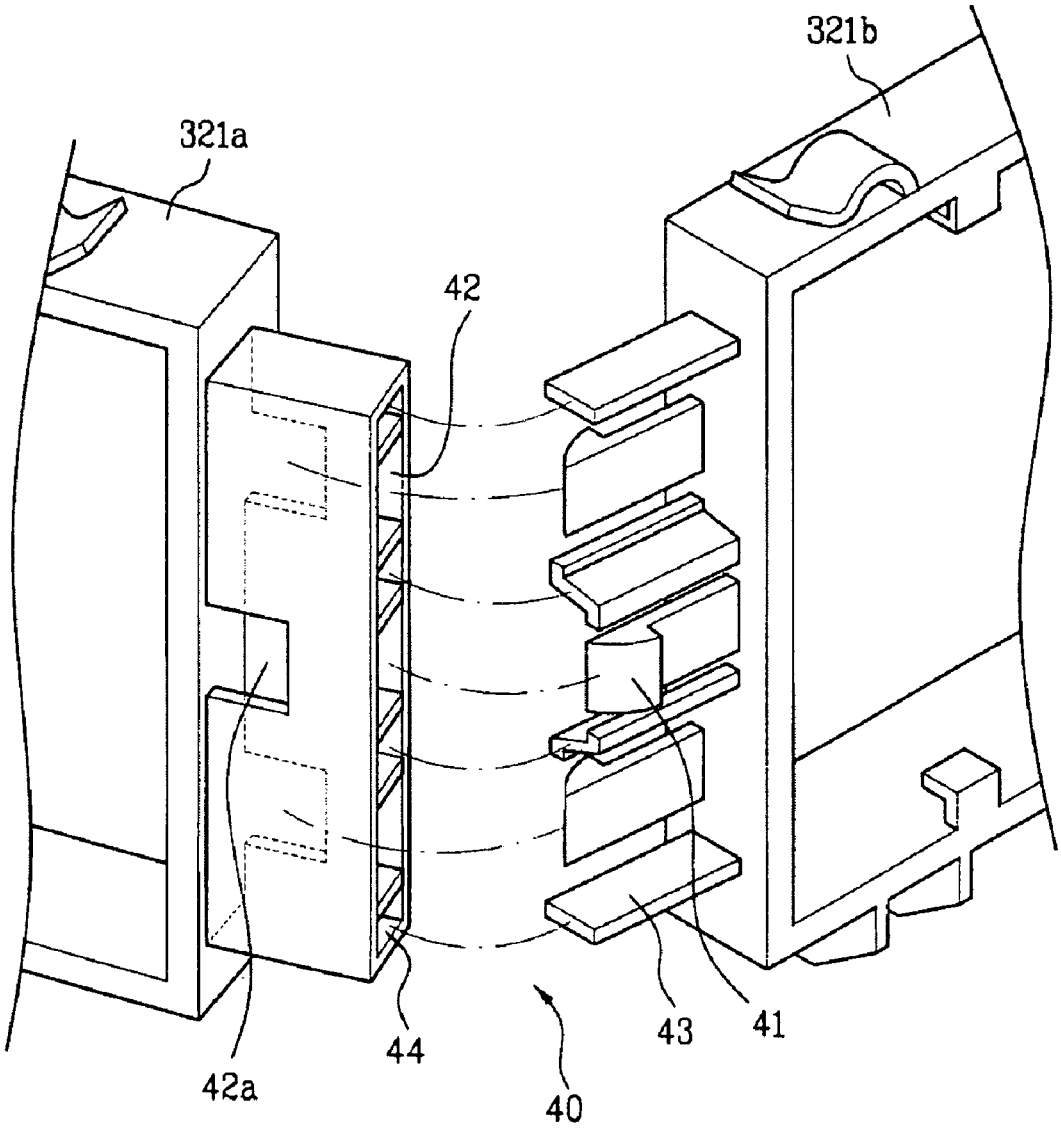
FIG. 7 illustrates an enlarged view of "A" part in FIG. 5.

It is preferable that the hooks 41 have holding directions different from adjacent one, more preferably, as shown in FIG. 7, opposite to adjacent one.

The socket shape of the joining surface 42 also has a plurality of hook holes 42*a* equal to a number of the hooks 41, and the hook holes 42*a* are formed in opposite directions of the joining surfaces 42 in order to match to the hooks 41 formed in opposite directions. According to this, a plurality of the joining surface 42 are formed.

Shapes of the hook 41 and the joining surface 42 are not limited to the embodiment.

Thus, as the hooks 41 are held at the hook holes 42*a*, the first body 321*a* and the second body 321*b* are coupled, and because the hooks 41 are held at the hook holes 42*a* in opposite directions, even if the coating guide 33 is pressed in one direction, the hooks 41 do not fall off the hook holes 42*a*, to couple the first body 321*a* and the second body 321*b*, more firmly.

Moreover, the joining portion 40 may further include guide means for guiding joining positions of the hooks 41 and the socket shape of joining surface 42.

Referring to FIG. 7, it is preferable that the position guiding means holds the first body 321*a* and the second body 321*b* so that the first body 321*a* and the second body 321*b* do not move in addition to a function for guiding joining positions of the hooks 41 and the joining surfaces 42.

The position guiding means includes a guide piece 43 projected from a side of the first body 321*a*, and a guide piece receiver 44 on a side of the second body 321*b* for receiving the guide piece 43.

It is preferable that at least one guide piece 43 is formed adjacent to each of the hooks 41.

It is preferable that the guide piece receiver 44 is formed within a space of the socket shaped joining surface 42 of the first body 321*a*.

It is preferable that the guide piece 43 is formed to fit in the guide piece receiver 44, for preventing the first body 321*a* and the second body 321*b* coupled together from moving.

A process for coupling the coating guide having bodies joined together to the control panel will be described.

The PCB 32 is mounted on the coating guide 33. Then, the coating guide 33 is fastened to the control panel 31 with screws.

In this instance, the fastening bosses 31*a* on the inside of the control panel 31 are brought into contact with the plurality of fastening portions 331 on the coating guide 33, respectively.

In this instance, the fastening boss 31*a* is guided by the holders 331*d* on the fastening portion 331 until the fastening boss 31*a* is in contact with the fastening surface 331*b* having the fastening hole 331*a*, such that the screw hole in the fastening boss 31*a* is aligned with the fastening hole 331*a* in the fastening portion 331.

In this instance, lateral movement of the fastening boss 31*a* is held by the holders 331*d* so that the fastening boss 31*a* is aligned with the fastening surface 441*b* exactly without any lateral movement.

Figure 8:
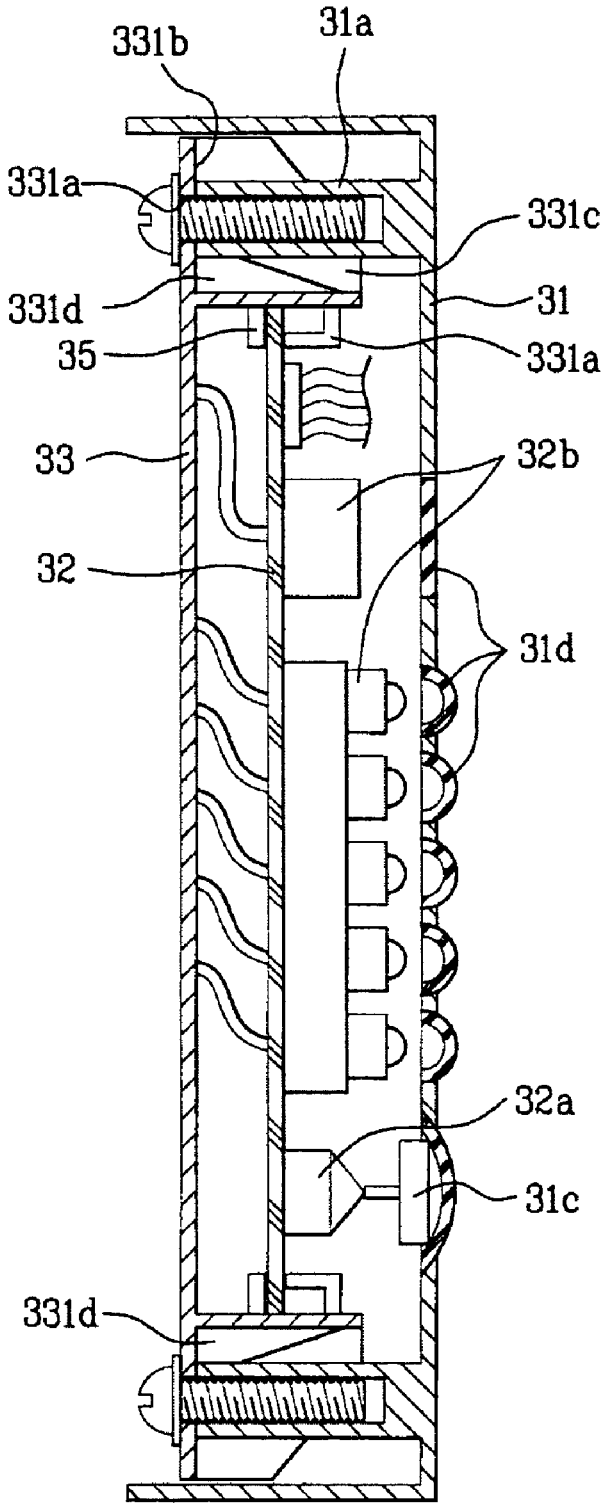
FIG. 8 illustrates a transverse section of a control unit of a drum type washing machine in accordance with a preferred embodiment of the present invention.

By this, referring to FIG. 8, the coating guide 33 can be easily fastened to the control panel 31 having the fastening boss 31*a* aligned with the fastening surface 441*b*, exactly.

In the meantime, the wires lead from the PCB 32 are fastened to the wire fastening ribs 36 on the upper portion and the lower portion of the body 321, to arrange the wires neatly, and to prevent the wires from coming between the body 321 and the control panel 31 to cause inaccurate assembly.

Figure 9:
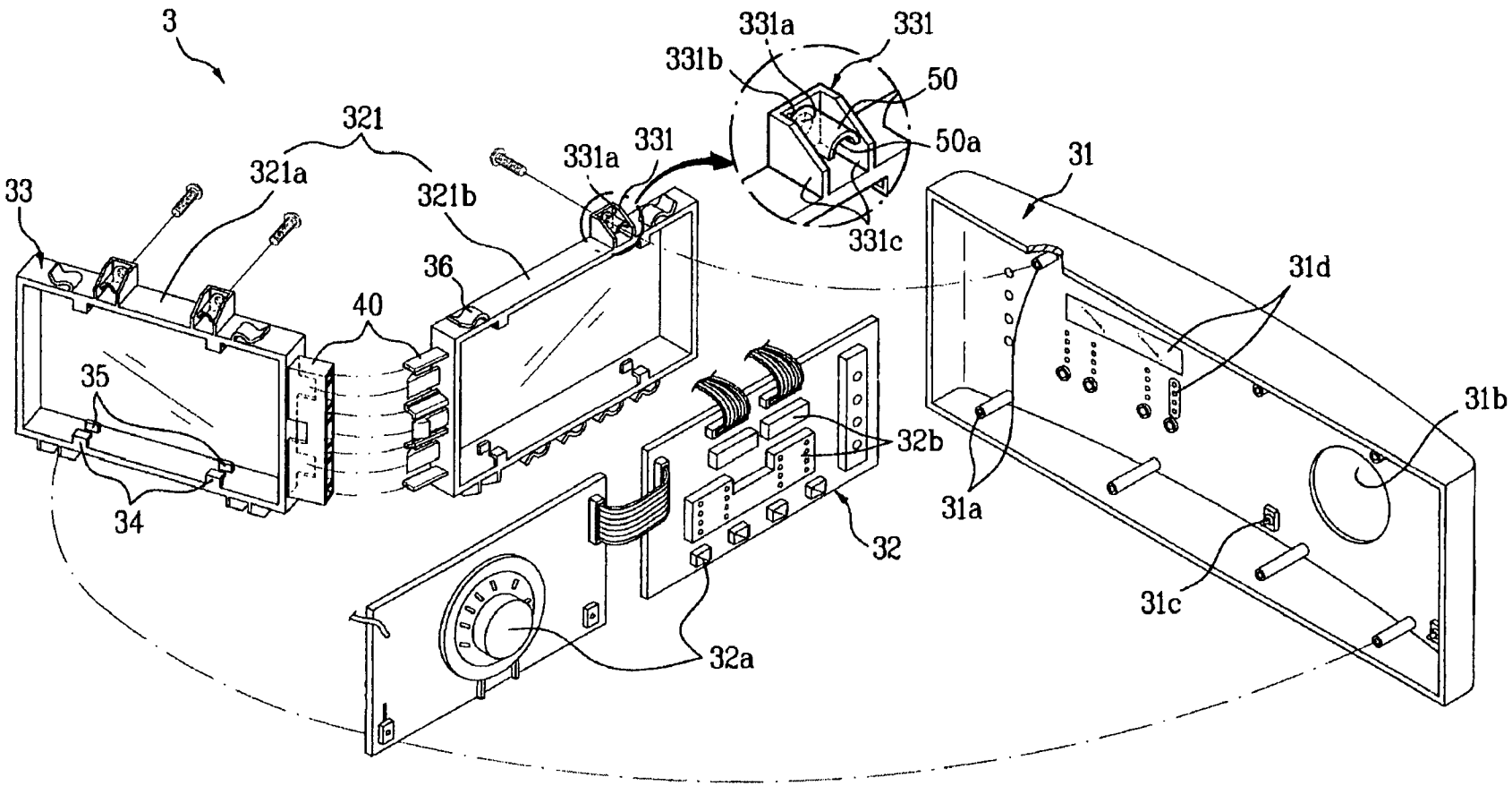
FIG. 9 illustrates an exploded perspective view of a control unit of a drum type washing machine in accordance with another preferred embodiment of the present invention.

A coating guide in a drum type washing machine in accordance with another preferred embodiment of the present invention will be described with reference to FIG. 9 attached herein.

The coating guide in a drum type washing machine in accordance with another preferred embodiment of the present invention is identical to the coating guide in a drum type washing machine in accordance with a preferred embodiment of the present invention, except the holder.

The holder 50 has a section of an arc around the fastening hole 331*a* of the fastening portion 331 projected from the fastening surface 331*b*, formed on upper and lower sides or right and left sides of the fastening hole 331*a*.

Though not shown, the holder 50 may have, not only a shape of the arc, but also a shape of a cylinder having the same arc.

If the holder 50 has the shape of a cylinder, it is preferable that an inside diameter of the cylinder has a size to allow the fastening boss slides in/out therethrough.

A process for assembling the control panel 31 to the coating guide 33 will be described.

Once an outside circumferential surface of the fastening boss 31*a* of the control panel 31 is placed on an inside circumferential surface of the arc or cylinder shaped holder 50, the fastening hole 331*a* of the fastening portion 331 having the holder 50 formed thereon is aligned with the screw hole in the fastening boss 31*a*.

In this instance, since the fastening portion, placed in the fastening boss 31*a*, does not move, the control panel 31 can be fastened to the coating guide 33 with screws, easily.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine comprising:

a drum;

a cabinet that forms an exterior of the laundry machine and protects the drum;

a control panel having operational buttons, and coupling portions;

a plurality of coating guides having fastening portions corresponding to the coupling portions for mounting to a rear surface of the control panel;

a plurality of printed circuit boards (PCB) respectively mounted on the coating guides each having an electric circuit mounted thereon;

joining portions for joining the respective coating guides so as to approach an inside of the control panel; and a plurality of holders for preventing the coupling portions and the fastening portions from moving with respect to each other at a time the coupling portions are brought closer to the fastening portions, respectively, and wherein the joining portion includes:

a hook on a first one of the coating guides, and a joining surface on a second one of the coating guides, the joining surface having a hook hole for holding the hook.

2. The laundry machine as claimed in claim 1, wherein the fastening portion includes walls on an upper portion of the coating guide having a fastening hole, and a holder that includes at least one rib projected from the wall at an area around the fastening hole.

3. The laundry machine as claimed in claim 2, wherein the holders are formed opposite to each other with respect to the fastening hole.

4. The laundry machine as claimed in claim 2, wherein the coupling portion includes a fastening boss, and the holder has an end sloped for easy placing in of the fastening boss.

5. The laundry machine as claimed in claim 4, wherein the holders opposite to each other with respect to the fastening hole is distanced enough to allow sliding of the fastening boss.

6. The laundry machine as claimed in claim 1, wherein the fastening portion includes walls on an upper portion of the coating guide, and a holder is a cylinder projected from the wall at an area around a fastening hole.

7. The laundry machine as claimed in claim 6, wherein the cylinder has an inside diameter with a size enough to allow sliding of a fastening boss.

8. The laundry machine as claimed in claim 1, wherein the fastening portion includes walls on an upper portion of the coating guide, and a holder is an arc projected from the wall at an area around a fastening hole.

9. The laundry machine as claimed in claim 8, wherein the holder is formed on an upper side and a lower side of the fastening hole.

10. The laundry machine as claimed in claim 8, wherein the holder is formed on a left side and a right side of the fastening hole.

11. The laundry machine as claimed in claim 1, wherein the joining portion is formed on a side of each of the coating guides.

12. The laundry machine as claimed in claim 1, wherein the coating guides joined together form an outside appearance having a curvature at which the PCBs and the operation buttons can be placed closer.

13. The laundry machine as claimed in claim 1, wherein at least one hook and hook hole are formed, respectively.

14. The laundry machine as claimed in claim 1, wherein the joining portion includes a plurality of hooks having holding directions to be held at hook holes different from one another.

15. The laundry machine as claimed in claim 1, wherein the joining portion further includes position guide means for guiding the hook to the hook hole for easy fastening of the hook to the hook hole.

16. The laundry machine as claimed in claim 15, wherein the position guide means includes:

a guide projection from one of the coating guides, and a guide projection receiver at another one of the coating guides for receiving the guide projection.

17. The laundry machine as claimed in claim 16, wherein the guide projection is adjacent to the hook.

18. The laundry machine as claimed in claim 16, wherein at least one of the guide projections and the guide projection receivers are formed, respectively.

19. A control unit assembly comprising:

a control panel having operation buttons and coupling portions;

a plurality of coating guides coupled to a rear surface of the control panel having fastening portions corresponding to the coupling portions;

a plurality of printed circuit boards respectively mounted on the coating guides, each of the circuit boards having an electric circuit mounted thereon;

a plurality of joining portions for joining the respective coating guides so as to approach an inside of the control panel; and a plurality of holders for preventing the coupling portions and fastening portions from moving with respect to each other when the fastening portions are aligned with the coupling portions, and wherein the joining portion includes:

a hook on one of the coating guide, and a joining surface on another one of the coating guides and having a hook hole for holding the hook.

* * * * *